United States Patent [19]

Bryan

[11] 4,134,188

[45] * Jan. 16, 1979

[54] METHOD FOR PROCESSING TUBULAR KNITTED FABRICS IN CONTINUOUS FORM

[75] Inventor: Clifford C. Bryan, Statesville, N.C.

[73] Assignee: Samcoe Holding Corporation, Woodside, N.Y.

[ * ] Notice: The portion of the term of this patent subsequent to Mar. 29, 1994, has been disclaimed.

[21] Appl. No.: 820,297

[22] Filed: Jul. 29, 1977

Related U.S. Application Data

[60] Division of Ser. No. 594,718, Jul. 10, 1975, Pat. No. 4,044,434, which is a continuation-in-part of Ser. No. 488,672, Jul. 15, 1974, abandoned.

[51] Int. Cl.[2] ..... D06C 5/00; D06C 27/00

[52] U.S. Cl. ..... 26/18.5; 26/81

[58] Field of Search ..... 26/18.5, 81

[56] References Cited

U.S. PATENT DOCUMENTS

| | | | |
|---|---|---|---|
| 448,817 | 3/1891 | Harder | 26/81 |
| 534,641 | 2/1895 | Tullar | 26/81 X |
| 1,334,164 | 3/1920 | Palmer | 26/81 |
| 1,804,097 | 5/1931 | Hahn | 26/18.5 UX |
| 2,494,808 | 1/1950 | Haeberlin | 26/18.5 |
| 2,588,624 | 3/1950 | Evans | 26/18.5 |
| 2,944,317 | 7/1960 | Cohn et al. | 26/18.5 |
| 3,007,223 | 11/1961 | Wehrmann | 26/81 X |
| 3,044,142 | 7/1962 | Brunner | 26/18.5 |
| 3,090,666 | 5/1963 | Jones | 26/18.5 X |
| 3,098,279 | 7/1963 | Brunner | 26/18.5 |
| 3,235,932 | 2/1966 | Jones | 26/18.5 |
| 3,484,949 | 12/1969 | Aronoff | 26/81 X |
| 3,585,696 | 6/1971 | Aronoff | 26/18.5 |
| 3,762,003 | 10/1973 | Frezza | 26/81 |
| 4,014,081 | 3/1977 | Bryan | 26/18.5 |

FOREIGN PATENT DOCUMENTS

| | | | |
|---|---|---|---|
| 1458135 | 10/1966 | France | 26/18.5 |
| 45-20159 | 7/1970 | Japan | 26/18.5 |
| 203764 | 9/1923 | United Kingdom | 26/81 |

*Primary Examiner*—Robert Mackey

*Attorney, Agent, or Firm*—Mandeville and Schweitzer

[57] ABSTRACT

A method for processing tubular knitted fabrics in a continuous form, wherein the tubular fabric is delivered in a substantially dry condition and the edge portions thereof are engaged for simultaneous conveyance and lateral stretching. In this manner, the fabric is stretched to a uniform, predetermined width. In accordance with the invention, the fabric is maintained free of externally applied moisture during the lateral distension of the fabric. The distended fabric is then discharged onto endless supporting surfaces while the edge portions are disengaged in a zone of predetermined dimensions to accommodate a controlled, lateral relaxation of the fabric. Thereafter, both faces of the laterally relaxed fabric are engaged between the endless supporting surfaces. During the time the fabric is engaged by the endless supporting surfaces, steam is applied over the entire area of the fabric to accommodate further relaxation and adjustment of the fabric. In accordance with the invention, the fabric is held in a controlled, continuous gripping engagement between the endless supporting surfaces throughout the conveyance of the fabric by the surfaces and all during the steaming operation. Moreover, moisture is removed from the supporting surfaces subsequent to the steaming of the fabric and prior to re-engagement of the supporting surfaces with the fabric.

4 Claims, 4 Drawing Figures

METHOD FOR PROCESSING TUBULAR KNITTED FABRICS IN CONTINUOUS FORM

This is a division of application Ser. No. 594,718, filed July 10, 1975, now U.S. Pat. No. 4,044,434, which is, in turn, a continuation-in-part of application Ser. No. 488,672, filed July 15, 1974, now abandoned.

BACKGROUND AND SUMMARY OF THE INVENTION

In the commercial manufacture of knitted sweaters, it is conventional to construct a complete sweater by assembling a plurality of separate, individually produced sections. Typically, sweater body sections may be knitted on a circular knitting machine in a manner to form a body portion of a first type of stitch, and an elastic waistband or cuff portion of a second type of stitch. The cuff portion is constructed to have greater elasticity than the body portion and is intended, in the finished sweater, to have a relatively restricted circumference measurement, as compared to the body portion. In the continuous production of such sweater sections, individual sections are connected together by removable draw threads. Typically, after preliminary processing of the connected-together sweater sections, the draw threads will be removed, and the final processing of the sections continues on an individual basis.

In the final processing of the sweater sections, prior to being laid up and cut to shape, and then sewed together with other sweater body parts, the sections are blocked or shaped by application over a shaping frame, followed by steaming. This framing and steaming operation is, in practice, carried out substantially as a hand operation, on a one at a time basis. Illustrative of the type of apparatus which can be used in such an operation, is the Cerami U.S. Pat. No. 3,118,579, for example. In a conventional framing and steaming operation, the body portion of the sweater section is slipped over framing elements which are set at a predetermined width. The cuff portion of the sweater either remains off of the spreader frame or, in some cases, is applied over a section of the frame having a substantially reduced width. While held on the frame, the body portion of the sweater is steamed momentarily. The sweater section remains on the frame briefly, after steaming, and then is withdrawn.

As will be appreciated, the conventional framing and steaming operation is relatively time consuming and laborious. In addition, processing results are far from being uniform, because timing of the operations is difficult to control effectively, and is therefore typically left up to the operator's judgment.

One advantageous procedure for processing sweater sections on a substantially automatic basis is reflected in the S. Cohn et al U.S. Pat. No. 2,944,317, in which connected-together sweater sections are passed over a distending frame and selectively steamed. Steam is thus applied to the body portion of the sweater section but is abruptly cut off as the cuff portion passes through the steaming area. The procedure of this patent greatly increased the rate of production in the framing and steaming operation and provides important advantages in the production of relatively nonsensitive fabrics.

The apparatus of the present invention represents a further important improvement over prior art apparatus, in providing for the processing of all types of fabrics, even those which are sensitive to pressure marking, and also in providing for a "flow-through" processing of the separated and individual sweater sections in a highly uniform manner.

A significant feature of the present invention resides in the fact that means are provided for assuring sweater sections and other so-called transfer fabrics, including portions of dissimilar construction and elasticity, are conveyed over a distending frame while in a substantially dry condition. Desirably, the amount of lateral distension imparted to the sweater sections is such as to bring the body portions of the sections to the desired width. The cuff portion of the sweater section is also distended to the same width as the body portion, in passing over the spreading frame. However, it is intended that the cuff portion, being more elastic than the body portion, will return to a narrower dimension than the body.

In accordance with the invention, the substantially dry sweater sections, after discharge from the distending frame, are engaged substantially across the full width thereof by a pair of opposed conveyor blankets. These blankets are mounted and guided in such manner that each sweater section is relatively unconfined for a short interval after its discharge from the spreading frame and prior to its engagement by the conveyor blankets. In this interval, which can be controllably adjustable by means provided for that purpose, the body portion of the sweater section assumes its desired width and the cuff section returns to a desired, narrower width. With the sweater section thus shaped, it is gripped lightly by the conveyor blankets, and while so gripped, is exposed to steam. Unlike conventional apparatus, in the new apparatus the steam is applied to both the body and cuff portions of the sweater section, and not to just the body portion alone.

After steaming, the sweater section is conveyed a short distance further by the opposed blankets, and then released. Suction means is provided to extract excess moisture from the fabric before its discharge from the processing station. In addition, suction or other means are provided so that condensed moisture is extracted from the conveyor blankets themselves, assuring that the fabric sections being discharged by the spreading frame are not affected by external moisture carried by the conveyor blankets.

In the typical utilization of the apparatus of the invention, individual sweater sections, which are originally connected together by removable draw threads, have been previously separated and are processed on an individual basis. Thus, although successive sweater sections may be fed into a processing machine in close, rapid succession, physical separation of one section from another is important to accommodate proper contraction of a cuff portion of one section without affecting the geometry of the body portion of an adjacent sweater section.

In order to achieve optimum readjustment and relaxation of the sweater sections after steaming, the opposed conveyors are arranged so that the sections are released from the grip of the conveyors and are conveyed on the lower blanket only. While the sweater blank is being thus conveyed, the lower conveyor blanket is subjected to vigorous agitation of substantial vertical amplitude, sufficient to literally lift the sweater material off of the conveyor blanket. The fabric is thereby enabled and encouraged to relax free of restraint by the surface of the conveyor blanket.

Certain aspects of the invention are also applicable to the processing of continuous tubular yard goods, as a finishing technique, suitable particularly in the handling of materials which are sensitive to marking. In the processing of continuous yard goods, the tubular fabric is first distended to a desired width, by an internal spreading device, and then discharged between the conveyor belts. A slight contraction of the fabric is permitted to occur in the interval of the discharge from the spreader and engagement by the conveyor belts, and the fabric is then engaged continuously by the belts while being steamed.

For a better understanding of the above and other features and advantages of the invention, reference should be made to the following detailed description, and the accompanying drawings.

DESCRIPTION OF A PREFERRED EMBODIMENT

Figure 1:
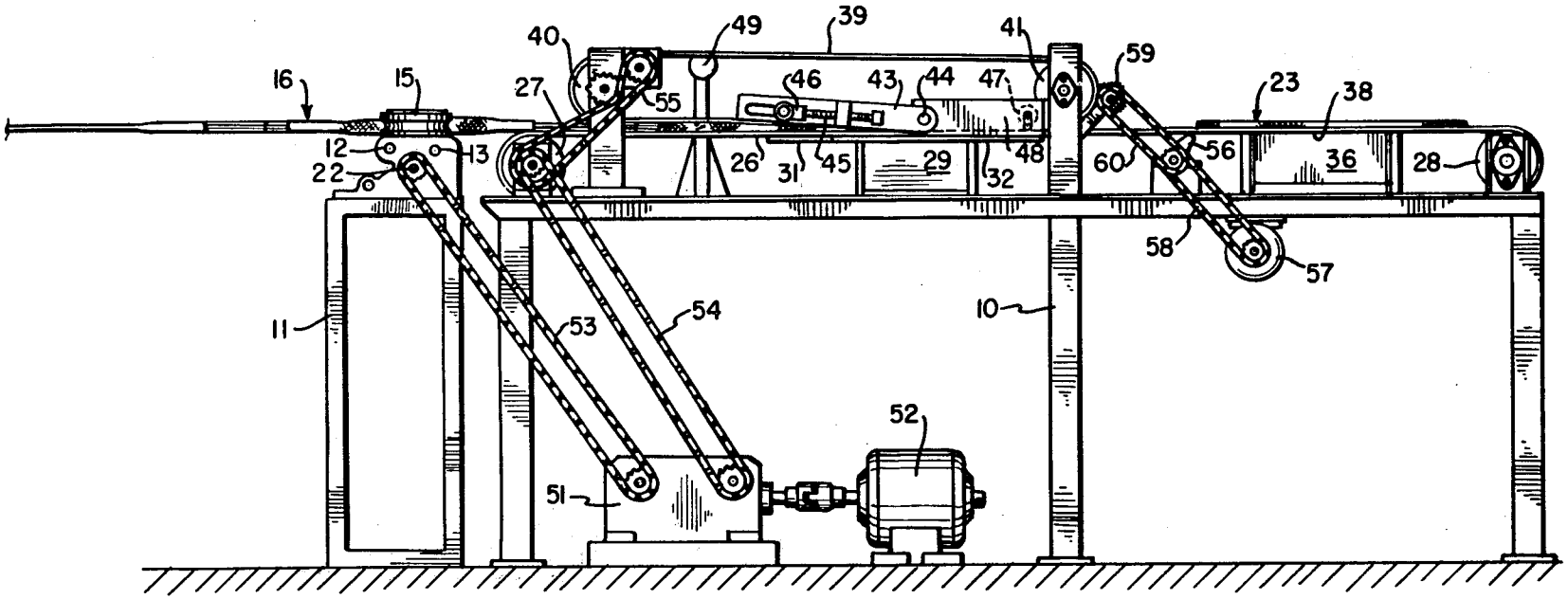
FIG. 1 is a side elevational view of an apparatus suitable for carrying out the process of the invention.

Referring now to the drawings, the reference numerals 10, 11 designate a suitable frame structure, on which the operating elements of the equipment are supported at a convenient level. The frame 11 supports a pair of transversely disposed guide rods 12, 13 on which are supported a pair of carriages 14. The carriages 14 rotatably support a pair of edge drive rolls 15 which cooperate in a known manner with a spreader frame, generally designated by the reference numeral 16 which may be of a conventional type. The spreader frame is provided with appropriate adjustable transverse supports 19, 20 for setting the spreader belts to desired width. The edge drive roll carriages 14 are adjustably positioned on the guide rods 12, 13 by means of a threaded shaft 21. A suitable splined drive shaft 22 rotates the edge drive rolls 15 in any adjusted position of the carriages 14.

To particular advantage, the apparatus of the invention incorporates a propeller-spreader 16 having a single pair of propelling belts for conveying the fabric sections without interruption, from the upstream section 17, through the region of the edge drive rolls 15, and along the downstream section 18. So-called dual or two-stage belt spreaders, having separate pairs of upstream and downstream belts, are less advantageous when processing a multitude of disconnected individual items because each item presents a free leading edge and it is possible to lose control over a leading edge as it is transferred from one belt stage to another, unless special precautions are taken. Such two-stage spreaders may be preferred, however, when processing continuous yard goods, in that it is possible with such two-stage spreaders to controllably overfeed the fabric between stages of the propeller.

The spreader frame 16, a well known and widely used piece of equipment in the processing of tubular knitted fabrics, is arranged to receive individual sweater sections 23 at the upstream end of the spreader and by motion of the belts 17–18 to advance the sweater sections longitudinally along the full length of the spreader frame, discharging the sweater sections at the downstream or discharge end. Typically, the upstream portion 17 of the belts are divergently related, to cause the fabric sections to be distended in circumference. The downstream portions 18 desirably are substantially parallel. For continuous goods processing the upstream belts may be driven at a slightly higher rate of speed than the downstream belts, to provide for a slight overfeeding and longitudinal relaxation of the fabric as it is transferred from one belt stage to another.

Figure 2:
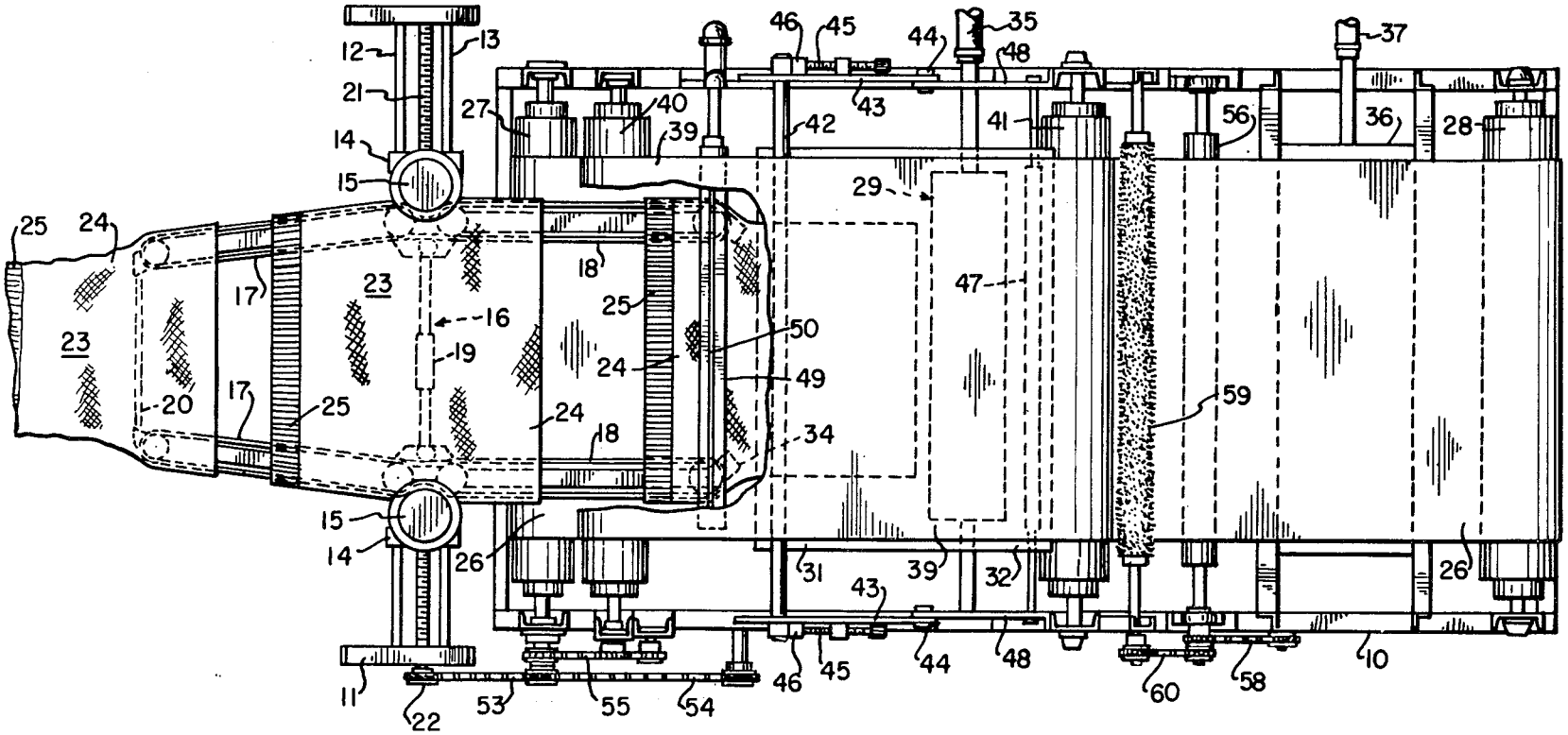
FIG. 2 is a top plan view of the apparatus of FIG. 1.

As reflected particularly in FIG. 2, the sweater sections 23 include body portions 24 and waistband or cuff portions 25. Conventionally, although the body and cuff portions 24, 25 are integrally knitted in a continuous operation, the stitch structure of the cuff portion is substantially different from that of the body portion, providing a greater contractibility and also a smaller nominal circumference in the cuff, as is well known. In addition, although the sweater sections 23 are knitted in a continuous series of connected-together sections, the present invention contemplates that the original, knitted sections will be separated prior to processing. Advantageous techniques for effecting this separation are described in the U.S. Pat. No. 3,797,080.

In accordance with the invention, the sweater sections 23, when applied to the spreader frame 16, are to be in a substantially dry state. By "substantially dry" it is meant that the sweater sections may contain a normal percentage of moisture content that the yarns will acquire by exposure to normal atmospheric conditions, but the sections must be free of any substantial amount of externally applied moisture, such as from a prior wet processing operation, or special steaming operation. In addition, it is a significant feature of the invention that the sweater sections shall remain in their substantially dry condition at all times while engaged by the spreader. This does not, of course, preclude the application of steam to the discharged leading end of a sweater section, while the trailing end remains on the spreader, but it does preclude the application of steam or other external moisture to any portion of the sweater section which still remains on the spreader frame.

Figure 3:
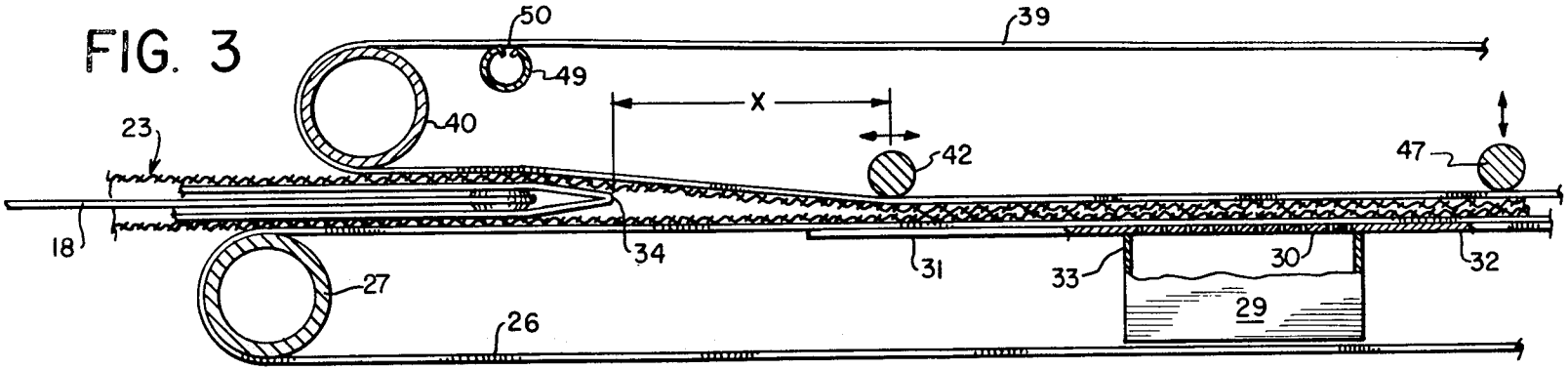
FIG. 3 is an enlarged fragmentary cross-sectional view, illustrating the relationship of the conveyor blankets to the discharge end of the spreading frame.

As reflected in FIGS. 1 and 3, the discharge end of the spreader frame projects somewhat over the top of an endless lower conveyor blanket 26. The conveyor blanket 26 is supported at its opposite ends by transverse rollers 27, 28 which are supported by the frame structure 10 in such a way as to guide the upper reach of the conveyor blanket 26 substantially in the same plane as the spreader frame 16, but immediately below the latter. The arrangement is such that the discharge end of the spreader frame may rest lightly on the conveyor blanket 26.

The conveyor blanket 26 may be constructed of a fine mesh woven material of a hydrophobic nature. In general, however, metal mesh materials are unsatisfactory because of their high heat conductivity. To great advantage, the conveyor belts may be constructed of a woven nylon mesh. In some cases, a highly perforated plastic web material may also serve adequately. The significant characteristics of the conveyor blanket 26 are nonabsorbency of moisture, relatively low heat conductivity and relatively high porosity to steam and air.

Underneath the upper reach of the conveyor blanket 26 is a steam box 29 having a perforated upper surface plate 30, flanges 31 and 32 of which may extend upstream and downstream from the side walls 33 of the steam box. The plate 30 and its flanges 31, 32 form a limited supporting surface for the conveyor blanket 26, as will be apparent in FIG. 3. As is also apparent in that Figure, the steam box is located somewhat downstream of the discharge end 34 of the spreader frame 16. The steam box is provided with an appropriate connection 35 to a steam supply. To advantage, the invention provides for steam to be supplied to the steam box 29 at low pressure. The entire upper surface area of the steam box desirably is perforated to provide a substantial outlet area for the steam. Thus, the low pressure steam supplied to the steam box 29, escapes with a minimum velocity, enabling a highly efficient utilization of steam in the process.

Also located beneath the upper reach of the conveyor blanket 26, downstream of the steam box 29, is a suction box 36, connected to a source of vacuum 37. The upper surface plate 38 of the suction box is suitably slotted to provide for a relatively high velocity flow of air into the suction box. As reflected in FIG. 1, the top plate 38 of the suction box forms a suitable support for the conveyor blanket 26 such that air driven into the suction box passes through the upper reach of the conveyor blanket as well as through a sweater blank 23 carried thereby. The suction box functions to draw air through the sweater section and through the conveyor blanket at a sufficient velocity to cool and reduce residual moisture contained in the sweater blank and also to cool and greatly minimize or eliminate moisture on the surface of the hydrophobic conveyor blanket material.

Pursuant to the invention, a second conveyor blanket 39 is provided, typically of the same material as the lower conveyor blanket 26, and in any event of a material having characteristics of being nonabsorbent of water, a relatively low conductor of heat and a relatively high porosity. The second conveyor blanket 39 is positioned above the first, being trained about rollers 40, 41. As reflected particularly in FIG. 1, the upper conveyor blanket 39 is substantially shorter in length than the lower conveyor blanket 26. In a typical embodiment of the invention, the lower conveyor blanket may extend several feet beyond the upper blanket, at the downstream or discharge end of the apparatus, providing a zone in which the fabric is cooled and its moisture content reduced by the action of the suction box 36, while remaining supported on the conveyor blanket 26 and being free to relax.

As also reflected in FIG. 1, the downstream roller 41, about which the upper conveyor blanket 39 is trained, is positioned between the steam box 29 and the suction box 36. Desirably, the roller 41 is located above an area of the lower conveyor blanket 26 which is unsupported by an opposing roll or other means, such that materials passing under the roller 41 are protected against exposure to concentrated localized pressure. If it is found necessary to support the lower conveyor blanket 26 in the region of the roller 41, adequate spacing should be provided to avoid the application of concentrated pressures by the roller 41.

In accordance with one aspect of the invention, the spreader frame 16 is so positioned relative to the conveyor blankets 26, 39 that the discharge end of the spreader extends for at least a short distance between the conveyor blankets. For convenience, the entry end rollers 27, 40 for the respective conveyor blankets are offset with respect to each other, such that the lower conveyor blanket extends somewhat further in the upstream direction than the upper conveyor blanket. The vertical spacing between the axes of the rollers 27, 40 is such as to freely accommodate the presence of the spreader frame, and a section of tubular fabric being conveyed thereby, without causing an appreciable amount of rolling pressure to be applied to fabric passing over the spreader. In this respect, the discharge end of the spreader frame can rest lightly on the lower conveyor blanket, and the lower reach of the upper conveyor blanket may lightly contact fabric on the top side of the spreader frame, but concentrated pressures of any kind are to be avoided, to prevent pressure marking of sensitive fabrics.

With reference to FIG. 3, the apparatus of the invention includes a floating guide roll 42, which is positioned above the flange lip 31 of the steam box cover plate and is positioned to bear lightly upon the lower reach of the upper conveyor blanket 39. In the illustrated arrangement, the floating guide roll 42 is supported at its ends by a pair of arms 43, pivoted to the machine frame at 44 and providing for a generally vertical floating action of the guide roll. In addition, the guide roll 42 is adjustable in a manner to provide a degree of control over the time in which the fabric is free of the spreader frame 16, but not yet fully engaged and gripped by the conveyor blankets 26, 39. In the arrangement specifically illustrated, such adjustment is made in the direction of conveyor movement, as by means of adjusting screws 45 carried by the pivoted arms 43 and adjustably positioning guide roll bearings 46. The arrangement is such, according to the invention, that the spacing "X" (FIG. 3) between the discharge end 34 of the spreader and the floating guide roll 42 may be adjusted in accordance with the requirements of the process.

A second floating guide roll 47 is positioned above the downstream flange 32 of the steam box cover plate. In the illustrated arrangement, the guide roll 47 may be supported in vertically slotted brackets 48, for example, to provide for the desired freedom of vertical motion. The floating guide rolls 42, 47, in conjunction with the steam box cover plate 30, provide a short area in which the conveyor blankets 26, 39 are lightly urged together and held close to the perforated cover of the steam box. The weight of the guide rollers is desirably no greater than necessary to press the upper conveyor blanket 39 onto the fabric, so that the fabric is lightly gripped thereby, while avoiding concentrated pressures.

At an appropriate position along the upper or return reach of the upper conveyor blanket 39, there is provided a suction box 49 having a transversely extending slot 50 exposed to the bottom surface of the blanket. As the blanket passes over the suction box, a relatively strong flow of air into the slot 50 serves to remove surface moisture from the blanket and also to cool the blanket somewhat. In this connection, maintaining the conveyor blankets substantially free of surface moisture at the entry end is regarded as important, to prevent moistening of the fabric while it remains on the spreader frame. It is a significant aspect of this invention, that the fabric be retained in a substantially dry state until it has been discharged from the spreader.

In the illustrated arrangement, the spreader frame and conveyor blankets are driven through a variable speed mechanism 51 and drive motor 52. A first drive chain 53 connects the variable speed mechanism 51 with the drive shaft 22 for the spreader edge drive rolls 15, while a second drive chain 54 connects the variable speed mechanism with the roller 27 supporting the lower conveyor blanket. The roller 40, supporting the upper conveyor blanket, is connected to the roller 27 by a third chain 55, to provide for synchronized movement of the upper and lower conveyor blankets. By appropriate control of the speed of the motor 52 and of the variable speed mechanism 51, the overall speed of the equipment may be controlled and also the speed of the spreader frame 16 may be varied relative to the speed of the conveyor blankets. In this respect, for certain fabrics it may be desirable to slightly overfeed or underfeed the fabric from the spreader frame into the conveyor blankets. Excess overfeeding of the fabric can result in undesirable wrinkling of the fabric, but this is readily observable by the machine operator, who can easily make correcting adjustments.

Located slightly upstream from the suction box 36, and downstream of the blanket roller 41, is a rotatable agitator bar 56, which is mounted for rotation closely underneath the upper reach of the lower conveyor blanket 26. The agitator bar 56 is driven by a motor 57 and chain 58 to rotate at relatively high speed. The bar is noncircular in cross-sectional configuration and thus, as it rotates, serves to repeatedly displace the conveyor blanket 26 upwardly with significant vertical amplitude. This introduces a strong and rapid cyclical vertical motion into the conveyor blanket, the effect of which is felt not only in the immediate region of the agitator bar 56, but also in the area of the steam box 29. This agitation induced by the bar 56 enhances and encourages relaxation of the sweater section during the steaming phase, as it passes over the steam box 29. It also encourages and enhances relaxation of the fabric during the cooling and drying phase, after it has been released by the upper conveyor blanket 39 and is supported only by the lower conveyor blanket 26. Thus, vigorous agitation imparted by the bar 56, having a substantial vertical amplitude, tends to lift the fabric off of the surface of the conveyor blanket, and thereby encourages relaxation of the fabric free of any frictional restraining action of the blanket 26.

With some fabrics and some conveyor blanket materials, there may be a tendency for the partially processed fabrics to adhere to the upper blanket as it commences its return about the roller 41. To counteract such tendency, it may be appropriate to utilize a roller 59 driven by a chain 60 from the high speed motor 57 and arranged to brush lightly against the conveyor blanket to free fabric tending to adhere thereto.

Sweater fabrics to be processed according to the invention, are conventionally connected together in the knitting operation by a removable draw string. For ease of handling, the sweater sections remain connected together in a web-like form throughout the various preliminary processing operations, up to and including washing and drying. Prior to processing according to the invention, however, the draw strings are removed, and the individual sections separated for individual processing. This is desired so that the shaping of the cuff section of one sweater blank will not be adversely affected by being connected to the body portion of an adjacent section. The individual sweater segments, in a substantially dry condition, having been dried after washing and remaining free of any special moisturizing operations, are applied one at a time to the upstream end of the spreading frame 16. It is an important feature of this invention, that the equipment enable the fabric to remain in its substantially dry condition at all times while it is in contact with the spreader.

The amount of spreading applied by the frame 16 typically is relatively small. For example, the sweater fabric having a 28 inch circumference when delivered off of the knitting machine may have been reduced to a 23–24 inch circumference as a result of the various previous processing operations, including washing and drying. Typically, such fabric may have desired circumference in the range 25–26 inches, in which case the spreader 16 would be set to distend the sweater sections to dimensions slightly larger than the desired circumference, providing for some amount of relaxation of the fabric to its desired circumference.

As the knitted sweater sections pass over the spreader, the entire sweater section, including the cuff portion as well as the body portion, is distended to a uniform width, as determined by the adjusted setting of the spreader. As the fabric is discharged from the spreader, it is momentarily unrestricted and therefore allowed to relax and contract laterally. The amount of such contraction may be controlled within limits, by adjustment of the positioning of the first floating guide roller 42. In the illustrated apparatus, this adjustment is made in the upstream or downstream direction. The optimum such adjustment is determined empirically with respect to a given article being processed. Generally, the adjustment is such that the cuff portion of the sweater section will differentially contract to its desired circumference, which is somewhat less than the desired circumference of the body portion of the sweater. Generally, the spacing should not be substantially greater than necessary to accomplish the foregoing objective, in order to retain maximum geometric control of the body portion of the sweater section.

After passing under the floating guide roll 42, the entire sweater body is lightly gripped and confined between the synchronously moving upper and lower conveyor blankets 39, 26, throughout the interval of travel between the spaced floating guide rolls 42, 47. While thus lightly gripped, the fabric is steamed, to effect moisturizing and lubricating of the fibers, and to accommodate relaxation of the stitches. During this steaming phase, the sweater section may be subjected to agitation transmitted to it from the lower conveyor belt 26, from the agitator bar 56. This encourages and enhances relaxation of the fabric structure, even though the sweater is lightly held by the conveyor blankets.

Shortly after the steaming phase, the sweater section emerges from underneath the relatively short upper conveyor blanket 39 and is separated from the upper blanket, if necessary, by the action of the rotating brush 59. The sweater then continues to be supported across its full width and conveyed by the lower conveyor blanket 26, passing directly over the agitator bar 56, which vigorously agitates the blanket and the sweater section with substantial vertical amplitude. In this region, since the sweater section is not restrained by the upper blanket, it can be lifted free of the lower blanket, and further relaxation is encouraged.

With continued movement of the conveyor blanket 26, the fabric section passes over the suction box 36, and the resulting relatively high velocity flow of air through the fabric section and conveyor blanket into the suction box serves to cool both the sweater and the conveyor blanket and to remove moisture therefrom. The fabric then continues to be conveyed by the blanket 26 to the discharge end of the apparatus, where it is removed manually or otherwise.

A unique feature of the above described apparatus, insofar as it is used for the processing of sweater sections, is the fact that the steamer is arranged in such manner that the cuff portion of the sweater section is fully steamed along with the body section. Significantly, however, the spreader frame is so arranged with respect to the other components that the "framing" stage of the processing is carried to completion and is discontinued while the fabric remains in a substantially dry condition, so that the highly elastic cuff section differentially contracts substantially to its desired dimension prior to the application of steam. Further, although the fabric is not engaged by the framing elements (the spreader 16) during the steaming phase, it is kept under substantial geometric control during that phase, by means of the defined relationship of the conveyor blankets and the spreader, providing a light, full surface gripping action of the opposed conveyor blankets 26, 39.

The ability of the new apparatus to pass the entire sweater blank over the spreader frame 16 without permanently distorting the cuff is in part enabled by the fact that means are provided to dry the conveyor blankets after steaming, and the fabric thus comes into the process in a substantially dry condition and in part by the fact that means are provided for drying both conveyor blankets after they have been exposed to steam, so they do not bring moisture of condensation back into contact with the fabric while it is in contact with the spreader frame.

The apparatus and procedure of the invention is also useful to great advantage in the processing of continuous yard goods, in which a continuous web-like length of tubular knitted fabric is processed as a finishing treatment. The processing of continuous yard goods, which is illustrated in FIG. 4 of the drawings, is carried out by apparatus generally similar to that shown in FIGS. 1–3, it being understood that the upper conveyor blanket 39 and related equipment is removed in FIG. 4 to facilitate illustration of the continuous goods.

Figure 4:
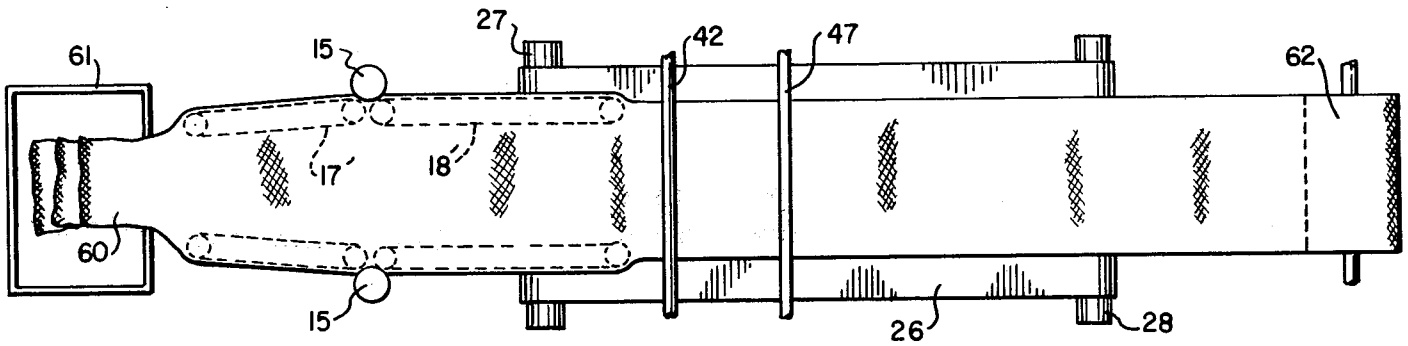
FIG. 4 is a simplified representation of the apparatus of the invention, with the upper conveyor blanket removed, as utilized in the processing of continuous yard goods.

In the apparatus and process of FIG. 4, substantially dry tubular knitted fabric 60 may be fed from a supply truck 61 and applied continuously over the spreader 16, thereby being distended to a predetermined, uniform width. The spreader may be a two-stage or dual spreader, in which case an initial stage of overfeeding may be imparted to the fabric by driving the upstream belts 17' slightly faster than the downstream belts 18', and a second stage of overfeeding, if desired, may be derived by operating the belts 18' at a slightly higher rate of speed than the conveyor belts 39, 26. Importantly, the continuous tubular fabric remains in substantially dry form until discharged from the spreader frame 16 and permitted to controllably relax and contract prior to passing under the floating guide roller 42. Thereafter, the fabric is lightly gripped and supported over its entire width between the belts 39, 26, while being exposed to low pressure steam from the steam box 29.

As in the case of the process of FIGS. 1–3, the continuous fabric in the process of FIG. 4 remains free of substantial concentrated pressure (e.g. calendering rolls) throughout its entire processing, including the period in which it is gripped by the conveyor blankets 39, 26. Relaxation and adjustment of the fabric structure is enhanced and encouraged during the steaming operation, and also during the subsequent cooling and drying phase by the action of the agitator bar 56. Upon discharge at the end of the lower conveyor blanket 26, the finished continuous fabric may be batched in rolls 62 or folded.

The process and apparatus of FIG. 4 are useful to particular advantage in connection with processing of sensitive or delicate fabrics, which are subject to pressure marking. In addition, the finished fabric has a highly uniform structure and geometry because the steaming, relaxation of the fabric structure occurs after the fabric has been discharged from the spreading frame. In this respect, part of the relaxation occurs during the steaming phase, while the fabric is lightly gripped by the conveyor blankets. Additional relaxation then takes place after the fabric has been released by the upper belt and is passing through the cooling phase during which moisture is extracted by the vacuum box 36. Relaxation is enhanced in most instances by the agitating action of the bar 56.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A method of processing tubular knitted fabrics in continuous form, which comprises (a) delivering the tubular fabric in substantially dry condition, (b) engaging the tubular fabric by internal edge portions and simultaneously advancing and laterally distending the fabric by its edges to a predetermined, uniform width, (c) maintaining the fabric free of externally applied moisture during lateral distension of the fabric, (d) discharging the distended fabric onto endless supporting surfaces while disengaging said edge portions in a zone of predetermined dimensions to accommodate controlled, lateral relaxation of the fabric, (e) thereafter, grippingly engaging, supporting and conveying both faces of the disengaged laterally relaxed fabric between said endless supporting surfaces, (f) steaming the relaxed fabric over its entire area while engaged between said supporting surfaces to accommodate further relaxation and adjustment of the fabric, (g) said fabric being held in a controlled, continuous gripping engagement between said endless supporting surfaces throughout steps (d) and (e), (h) thereafter, releasing said relaxed fabric from said gripping engagement while continuing to support said fabric across the full width thereof, and (i) removing residual moisture from said supporting surfaces subsequent to the steaming of the fabric and prior to re-engagement of the supporting surfaces with the fabric.

2. The method of claim 1, further characterized by (a) controlling the lateral relaxation of the fabric by controlling the dimensions of said zone between the discharge of the distended fabric and the gripping engagement, support, and conveying of both faces thereof.

3. The method of claim 1, further characterized by (a) after releasing said fabric from said gripping engagement continuing to support said fabric on one of said endless supporting surfaces.

4. The method of claim 3, further characterized by (a) supporting said relaxed fabric on its lower face only, (b) agitating the supported relaxed fabric with sufficient vertical amplitude to lift said fabric off of its supporting surface, and (c) thereafter cooling and drying the agitated fabric.

* * * * *